US007579303B2

(12) United States Patent
Varadaraj et al.

(10) Patent No.: US 7,579,303 B2
(45) Date of Patent: Aug. 25, 2009

(54) POLAR SOLVENT-ASPHALTENE DISPERSANT METHOD FOR UPGRADING HEAVY OILS

(75) Inventors: Ramesh Varadaraj, Flemington, NJ (US); Cornelius Hendrick Brons, Easton, PA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 393 days.

(21) Appl. No.: 11/173,978

(22) Filed: Jul. 1, 2005

(65) Prior Publication Data

US 2006/0014654 A1 Jan. 19, 2006

Related U.S. Application Data

(60) Provisional application No. 60/588,740, filed on Jul. 16, 2004.

(51) Int. Cl.
*C10C 1/00* (2006.01)
*C10C 1/18* (2006.01)
*C07C 303/44* (2006.01)

(52) U.S. Cl. ..... 508/416; 208/39; 208/45

(58) Field of Classification Search ..... 508/416; 208/39, 45, 309, 416
See application file for complete search history.

(56) References Cited

U.S. PATENT DOCUMENTS 4,713,117 A * 12/1987 Goodrich ..... 106/273.1
6,569,821 B1 * 5/2003 Ibrahim et al. ..... 508/396
2004/0232044 A1 * 11/2004 Mukkamala ..... 208/48 AA
2004/0235684 A1 * 11/2004 Cook et al. ..... 508/234

* cited by examiner

*Primary Examiner*—Walter D Griffin
*Assistant Examiner*—Frank C Campanell
(74) *Attorney, Agent, or Firm*—Gary P. Katz

(57) ABSTRACT

A method for reducing the viscosity and toluene equivalence of an oil containing asphaltenes comprises the steps of: a) mixing with the oil, a polar solvent, and an asphaltene dispersant additive wherein the weight ratio of oil:polar solvent is in the range of 10:0.1 to 10:5, the asphaltene dispersant additive is at a treat rate in the range of 0.025 to 5 weight percent based on the weight of the oil, and then, b) removing at least 90 wt % of the polar solvent from the mixture of oil, polar solvent and the asphaltene dispersant additive to provide upgraded oil with reduced viscosity and toluene equivalence.

6 Claims, 5 Drawing Sheets

POLAR SOLVENT-ASPHALTENE DISPERSANT METHOD FOR UPGRADING HEAVY OILS

FIELD OF THE INVENTION

This application claims the benefit of U.S. Provisional application 60/588,740 filed Jul. 16, 2004.

The present invention relates to methods for upgrading heavy oils.

BACKGROUND OF THE INVENTION

Heavy oils are generally referred to those oils with high viscosity or API gravity less than about 23. Crude oils and crude oil residuum derived from atmospheric or vacuum distillation of crude oil are examples of heavy oils. The origin of high viscosity in these heavy oils has been attributed to high asphaltene content and the asphaltene aggregation phenomenon. Viscosity reduction of heavy oils is important in production, transportation and refining operations of heavy oils. Fouling of metal surfaces by asphaltene containing oils is also a problem in heavy oil refining and transportation. The fouling tendency of an oil is generally evaluated by measuring the toluene equivalence (TE) number for the oil. A need exists to find effective methods to reduce viscosity and fouling tendency of oils containing asphaltenes. The instant invention addresses these needs.

SUMMARY OF THE INVENTION

One embodiment is a method for reducing the viscosity and toluene equivalence of an oil containing asphaltenes comprising the steps of:

a) mixing with the oil, a polar solvent, and an asphaltene dispersant additive wherein the weight ratio of oil:polar solvent is in the range of 10:0.1 to 10:5, the asphaltene dispersant additive is at a treat rate in the range of 0.025 to 5 weight percent based on the weight of the oil, and then, b) removing at least 90-wt % of the polar solvent from the mixture of oil, polar solvent and the asphaltene dispersant additive to provide upgraded oil with reduced viscosity and toluene equivalence.

DESCRIPTION OF THE INVENTION AND PREFERRED EMBODIMENTS

Figure 1:
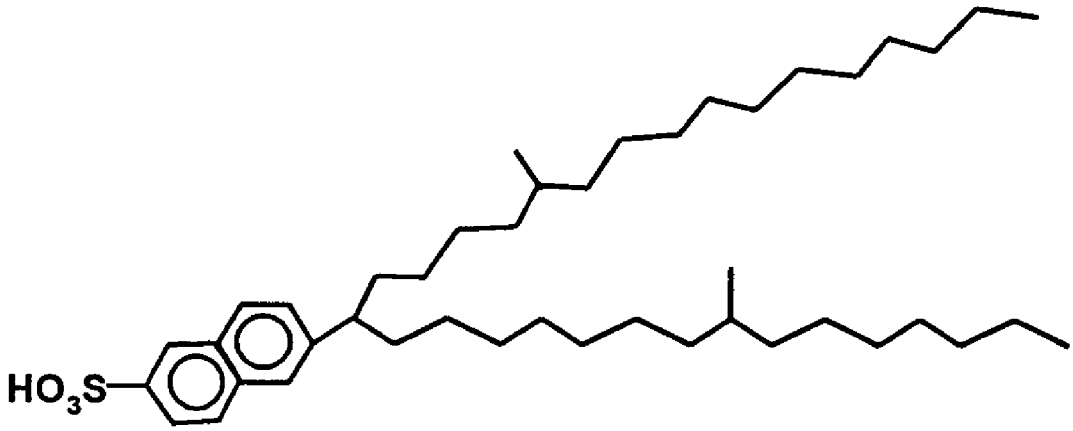
FIG. 1 is the chemical structure of a branched alkyl naphthalene sulfonic acid asphaltene dispersant additive denoted as NSA.
Figure 2:
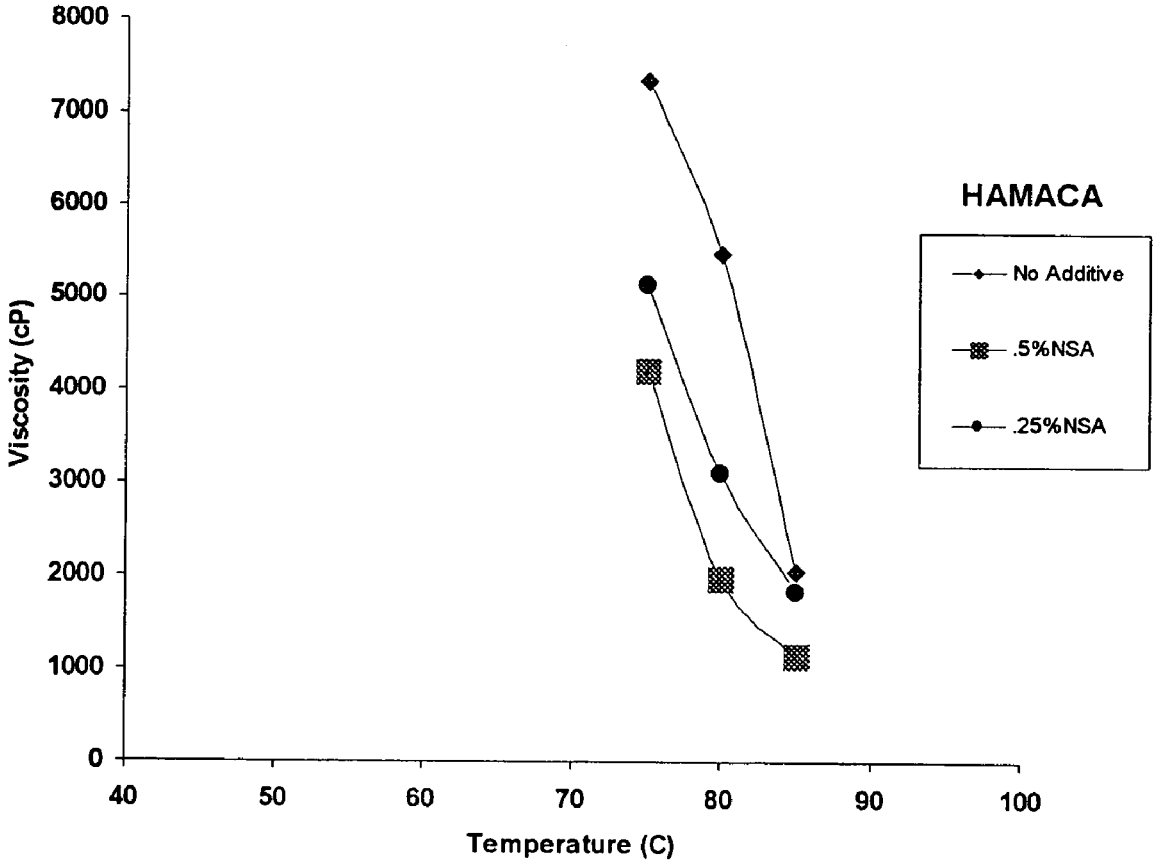
FIG. 2 is a plot of viscosity versus temperature for Hamaca oil. The diamonds represent the oil with no additive, the squares represent the data for 0.5 wt % NSA additive treated oil, the circles represent data for 0.25 wt % NSA additive treated oil.
Figure 3:
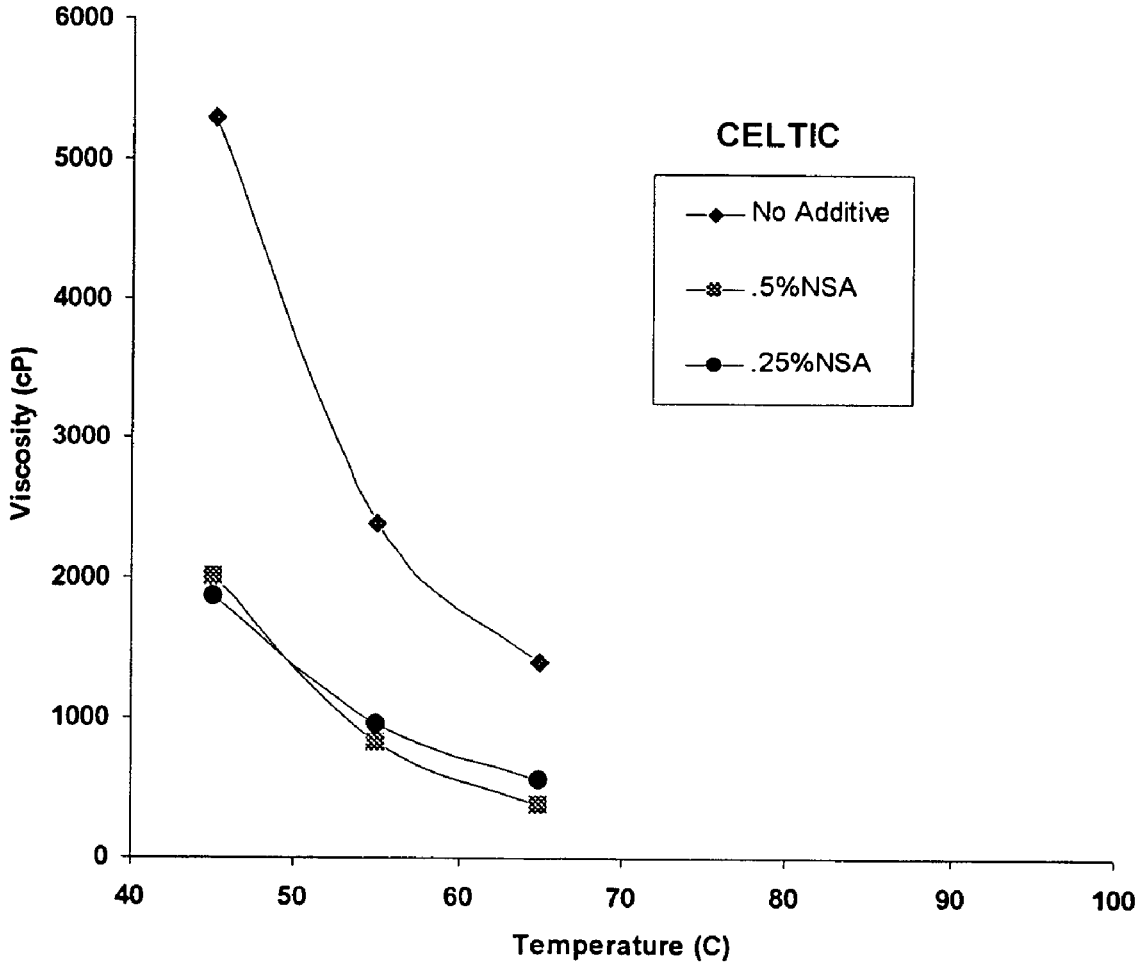
FIG. 3 is a plot of viscosity versus temperature for Celtic oil. The diamonds represent the oil with no additive, the squares represent the data for 0.5 wt % NSA additive treated oil, the circles represent data for 0.25 wt % NSA additive treated oil.
Figure 4:
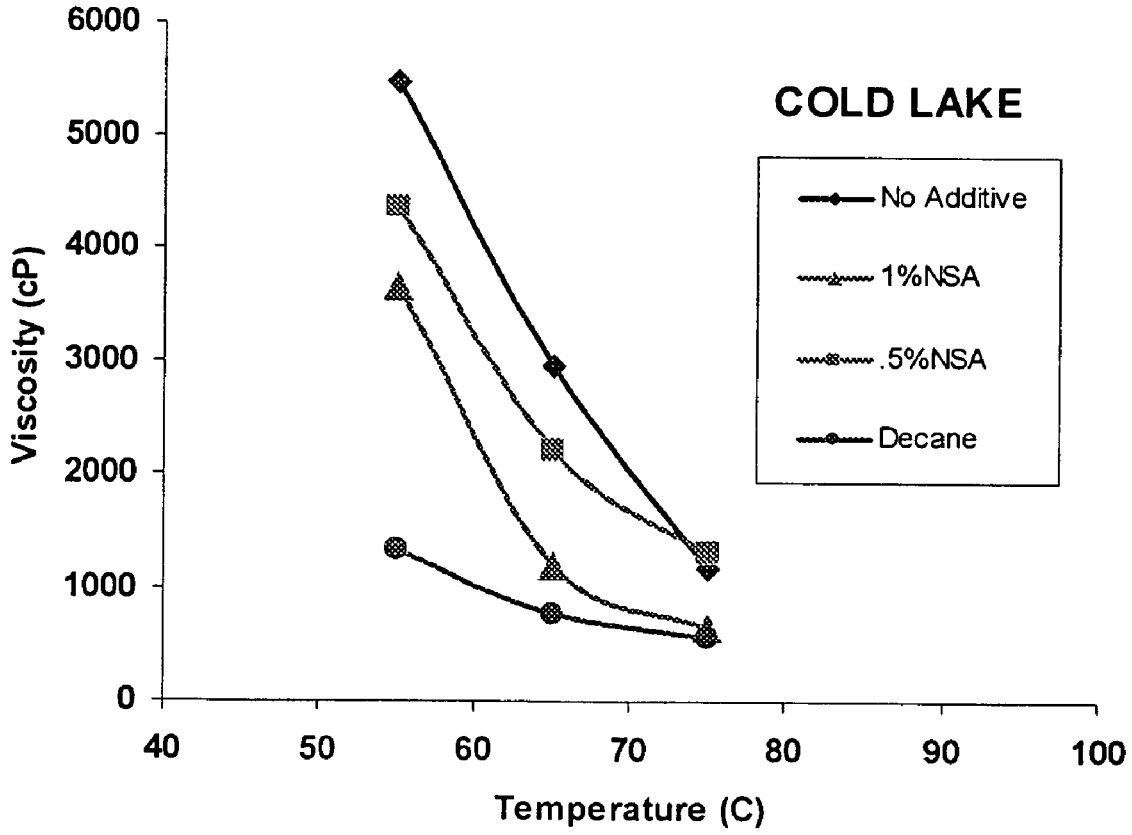
FIG. 4 is a plot of viscosity versus temperature for Cold Lake oil. The diamonds represent the oil with no additive, the squares represent the data for 0.5 wt % NSA additive treated oil, the circles represent data for 0.25 wt % n-decane a treated oil and the triangles represent the data for 1.0 wt % NSA additive treated oil.
Figure 5:
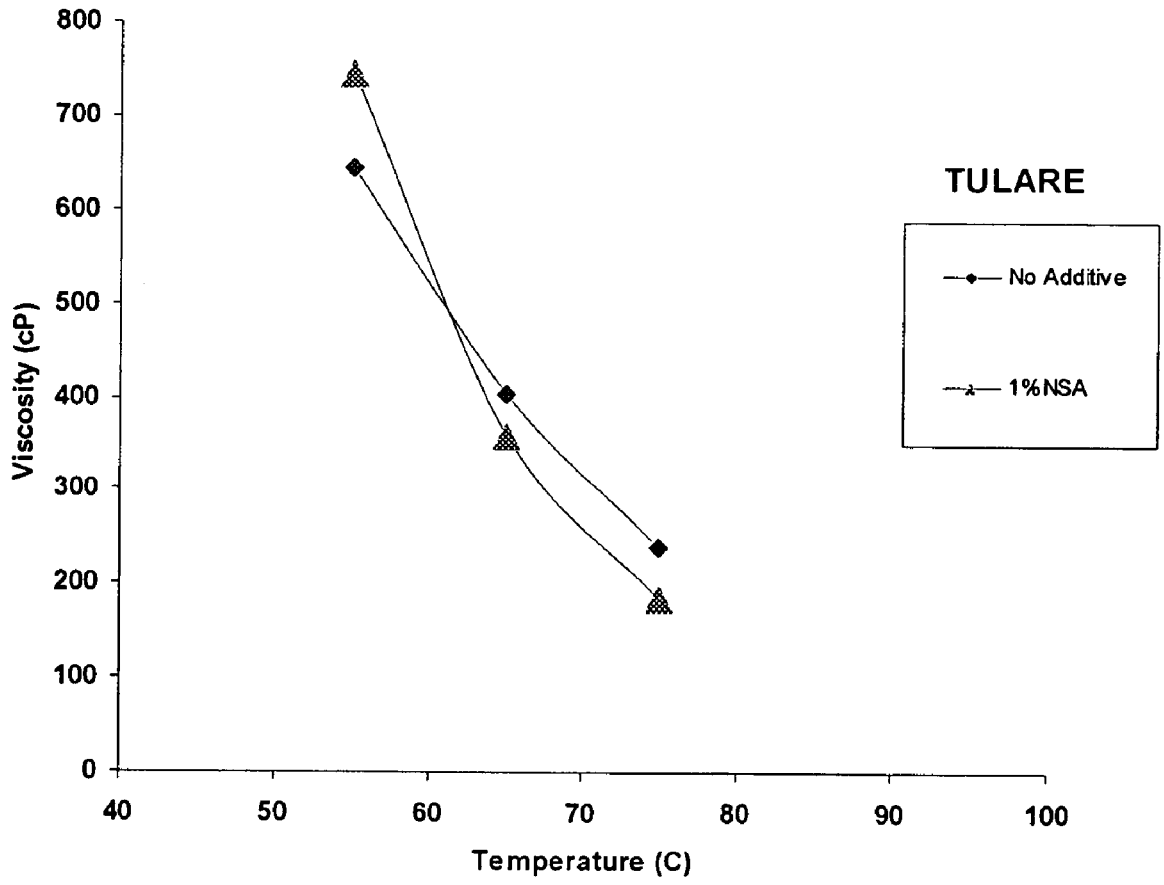
FIG. 5 is a plot of viscosity versus temperature for Tulare oil. The diamonds represent the oil with no additive, the triangles represent the data for 1.0 wt % NSA additive treated oil.

A treatment process comprising first mixing with an oil, a polar solvent and an asphaltene dispersant additive, followed by removal of substantially all of the polar solvent results in an upgraded oil wherein a simultaneous reduction in viscosity and toluene equivalence is achieved. Two possible order of addition sequence for the polar solvent and asphaltene dispersant additive can be used. In one preferred order of addition sequence, first the polar solvent is added to the oil followed by asphaltene dispersant addition and then removal of substantially all of the polar solvent. In another preferred order of addition sequence, first the asphaltene dispersant additive is added to the oil followed by polar solvent addition and then removal of substantially all of the polar solvent. The preference of order of addition of polar solvent and asphaltene dispersant additive can be made based on the additive and polar solvent selected. For example, if a polar solvent such as liquid CO2 is selected it is preferred to add the asphaltene dispersant additive first to the oil followed by the polar solvent addition.

The method on the instant invention is a novel solution to the long-standing problem of effective de-aggregation of asphaltenes in an oil containing asphaltenes. The method of the instant invention uses a polar solvent recycling approach in combination with an asphaltene dispersant additive to achieve the desired effect. Not wishing to be bound to the mechanism in any manner applicants believe the polar solvent aids to first de-aggregate the asphaltenes and the asphaltene dispersant additive interacts and binds with the de-aggregated asphaltenes. The polar solvent is then removed from the oil and dispersant additive mixture and is available for reuse. The availability of the polar solvent for reuse is a major advantage as the amount of polar solvent required for the process is limited to the size of the process equipment and the amount of oil treated in a single batch. Smaller amounts of polar solvent use also translates to cost effectiveness for the overall process.

The polar solvents for the practice of the invention are preferably low boiling inert solvents. Preferably the boiling range of the polar solvents is between 25° C. to 80° C. at atmospheric pressure. Such a boiling range enables easy evaporation of the solvent at the removal step. Solvents boiling above 80° C. can be used and with such solvents it is preferred to remove the solvent under suitable reduced pressure known to one of ordinary skill in the art of solvent removal techniques. The choice of polar solvent can be made based on the oil requiring upgrading. One factor to be taken into consideration is the amount of light ends i.e., fractions of the oil boiling in the same range as the polar solvent. Generally heavy oils and oils containing asphaltenes requiring upgrading has minor quantities of light ends or fractions boiling below about 80° C. Thus the invention is particularly suitable for heavy oils such as heavy crude oils and residua of crude oils obtained from crude oil distillation.

The polar solvents are preferably aromatic solvents, oxygenated solvents, chlorinated solvents and mixtures thereof. Some non-limiting examples of preferred aromatic solvents are toluene, xylenes and mixtures thereof. Some non-limiting examples of preferred oxygenated solvents are alcohols such as ethanol, methanol, propanol, tetrohydrofuran and n-methyl pyrrolidone and mixtures thereof. Some non-limiting examples of preferred chlorinated solvents are solvents such as methylene chloride. Mixtures of aromatic, oxygenated and chlorinated polar solvents can also be used. Liquid carbon di-oxide, liquid sulfur di oxide, liquid hydrogen sulfide and mixtures of liquid $CO_2$, $SO_2$, $H_2S$ can also be used. When liquid $CO_2$, $SO_2$, $H_2S$ are used the process is conducted at pressures wherein the $CO_2$, $SO_2$, $H_2S$ are in liquid state. The preferred treat rate for the polar solvent is in the range of oil to polar solvent at a weight ratio of 10:0.1 to 10:5. More preferably in the range of oil to polar solvent at a weight ratio of 10:0.1 to 10:1.

The asphaltene dispersant additive for the practice of the instant invention are asphaltene dispersant additives known to one of ordinary skill in the art of asphaltene dispersants and crude oils. The preferred asphaltene dispersant additive has the general chemical structure: R—Ar—$SO_3H$ wherein R is an alkyl group of 8 to 40 carbon atoms, Ar is an aromatic group of 2 to 6 homo-nuclear aromatic rings and the $SO_3H$ group is on any one of the homo-nuclear aromatic rings. Applicants have found that alkyl aromatic sulfonic acids of the type shown in FIG. 1 are particularly effective in simultaneous reduction of viscosity and toluene equivalence when used in the method of the instant invention. One feature of the preferred additive is the twin tailed "Y" branched alkyl chain that is further branched with methyl and ethyl groups. The alkyl chain length is preferably from 18 to 40 carbon atoms. The number of alkyl groups on the twin tail "Y" branch is preferably a total of 1 to 10. FIG. 1 shows a naphthalene sulfonic acid (NSA) additive as an illustrative example. The polynuclear aromatic group of the additive are preferably 2 to 5 fused homo-nuclear aromatic rings. The asphaltene dispersant additive is added to the mixture of oil and polar solvent at a treat rate preferably in the range of 0.025 to 5 weight percent based on the weight of the oil. The oil, polar solvent and additive are mixed by mixing methods known to one of ordinary skill in the art of mixing for a time period preferably in the range of 0.5 minute to 60 minutes. Longer mixing times for example 4 to 8 hours is preferred when the mixing is conducted at temperatures lower than about 25° C.

The last step of the method involves removing the polar solvent from the mixture of oil, polar solvent and the asphaltene dispersant additive to provide upgraded oil with reduced viscosity and toluene equivalence. Removal of the polar solvent can be by any removal means such as but not limited to thermal evaporation techniques known to one of ordinary skill in the art of solvent removal. Mixing during thermal evaporation is preferred. Paddle type mixing or a rotary mixing wherein the vessel itself may be moved in rotary fashion can achieve mixing during evaporation. It is also preferable to use a vacuum during solvent removal to further aid in the removal of the solvent. Preferably at least 90 wt % of the added polar solvent is removed. More Preferably up to 95% is removed and even more preferably up to 99% is removed and most preferably 100% of the solvent is removed.

For the purposes of demonstrating the invention an additive (NSA) of the structure shown in FIG. 1 was used. Methylene chloride was used as the polar solvent. As disclosed above, the invention is not limited to this combination. Suitable choice of additive and polar solvent can be used.

General Experimental Procedure

In a typical experiment 20 g of the crude oil was placed in a beaker and 10 to 50 ppm of methylene chloride was added to the crude oil and mixed for 10 minutes at 25° C. To the methylene chloride treated crude oil was added 0.002 g of a C30 alkyl naphthalene sulfonic acid of the chemical structure shown in FIG. 1. The mixture was mixed for 30 minutes. After mixing the methylene chloride was evaporated by heating the beaker to about 60° C. under nitrogen purge. All of the added methylene chloride was removed by the evaporation. After completion of experiment, the additized crude oil and the control samples were analyzed for toluene equivalence and viscosity. Viscosity was determined at three temperatures in the range of 45 to 80° C. in a shear range of 0.1 to 100 $sec^{-1}$. Four crude oils were examined Hamaca, Celtic, Cold Lake, and Tulare crude oils.

Control Experiments

Two control experiments were conducted for each crude oil sample. In control experiment-1 polar solvent methylene chloride was added and then removed as described in the general experimental procedure. No additive was added in control experiment-1. In control experiment-2 additive was added as described in the general experimental procedure. No polar solvent addition or removal was done.

No change in viscosity or toluene equivalence was observed between the untreated crude oil and crude oil from control experiments 1 and 2. The control experiments indicate that the additive by itself is ineffective and the method of the instant invention renders the additive effective. Likewise, the polar solvent addition and subsequent removal by itself is ineffective. The combination of polar solvent and asphaltene dispersant with subsequent removal of the polar solvent is most effective.

Viscosity

FIGS. 2-5 summarize the viscosity effects for Hamaca, Celtic, Cold Lake, and Tulare crude oils respectively. As can be seen from the data up to 75% decrease in viscosity can be achieved for Hamaca, Cold Lake and Celtic crude oils. The viscosity change observed for Tulare crude oil is relatively less. Tulare crude oil is has a low asphaltene content (2.6 wt %) oil whereas the Hamaca, Cold Lake and Celtic crude oils are high in asphaltene content. The asphaltene content (n-heptane insoluble wt % based on the weight of the oil) for Hamaca, Cold Lake and Celtic crude oils are 16.3, 21.2 and 11.2 wt % respectively. This data indicates that the method of the instant invention is particularly suitable for high asphaltene content crude oils. Preferably the asphaltene content of the oil is greater than about 2 wt % and more preferably greater than about 5 wt %.

Toluene Equivalence

Toluene equivalence is defined as the percent toluene (asphaltene solvent) in n-heptane (asphaltene non-solvent) required to keep asphaltenes in an oil in solution. This toluene equivalence test and the toluene equivalence number TE, enables determination of the effectiveness of asphaltene dispersants. The determination of TE for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is non-polar and a solvent for the asphaltenes in the oil while the other liquid is non-polar and a non-solvent for the asphaltenes in the oil. Since asphaltenes are defined as being insoluble in n-heptane and soluble in toluene, it is most convenient to select the same n-heptane as the non-solvent for the test liquid and toluene as the solvent for the test liquid. Although the selection of many other test non-solvents and test solvents can be made, there use provides no better definition of the preferred test process than the use of n-heptane and toluene described here.

A convenient volume ratio of oil to test liquid mixture is selected for the first test, for instance, 1 ml. of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. The microscope method was used to determine asphaltene solubility. The method is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed.

Two crude oils, Celtic and Cold Lake were analyzed for toluene equivalence change after subject to the method of the instant invention. Results are shown in Table-1. As can been seen a reduction in TE is observed for the oils treated by the method of the instant invention. Thus the method of the instant invention is novel in effecting a simultaneous reduction in viscosity and toluene equivalence.

TABLE 1

| Oil | TE |
|---|---|
| Cold Lake | 28 |
| Cold Lake + 0.1% NSA | 18 |
| Celtic | 20 |
| Celtic + 0.1% NSA | 13 |

What is claimed is:

1. A method for reducing the viscosity and toluene equivalence of an oil containing asphaltenos comprising the steps of:

a) mixing with the oil, a polar solvent and an asphaltene dispersant additive wherein the weight ratio of oil: polar solvent is in the range of 10:0.1 to 10:5, the asphaltene dispersant additive is at a treat rate in the range of 0.025 to 5 weight percent based on the weight of the oil, and then, b) removing at least 90 wt % of the polar solvent from the mixture of oil, polar solvent and the asphaltene dispersant additive to provide upgraded oil with reduced viscosity and toluene equivalence, and c) wherein said polar solvent is selected from the group consisting of chlorinated solvents, liquid $CO_2$, liquid $SO_2$, liquid $H_2S$ and mixtures thereof.

2. The method of claim 1 further comprising first adding the asphaltene dispersant additive to the oil followed by the polar solvent addition prior to the mixing step a).

3. The method of claim 1 further comprising first adding the polar solvent to the oil followed by the asphaltene dispersant additive addition prior to the mixing step a).

4. The method of claim 1 wherein said asphaltene dispersant additive has the chemical structure: R—Ar—$SO_3H$ wherein R is an alkyl group of 8 to 40 carbon atoms, Ar is an aromatic group of 2 to 6 homo-nuclear aromatic rings and the $SO_3H$ group is on any one of the homo-nuclear aromatic rings.

5. The method of claim 1 wherein said oil contains at least 2 wt % of asphaltenes based on the weight of the oil.

6. The asphaltene dispersant additive of claim 4 wherein R is a branched alkyl group of 18 to 40 carbon atoms, Ar is an aromatic group of 2 to 6 fused homo-nuclear aromatic rings and the $SO_3H$ group is on any one of the homo-nuclear aromatic rings.

* * * * *